US005680855A

United States Patent [19]

Ko

[11] Patent Number: 5,680,855

[45] Date of Patent: Oct. 28, 1997

[54] INDOOR FIREPLACE

[76] Inventor: Wen-Hsiung Ko, No. 9, Lane 339, Pei Yang Road, Fan Yuan City, Taichung Hsien, Taiwan

[21] Appl. No.: 587,523

[22] Filed: Jan. 17, 1996

[51] Int. Cl.[6] ..... F24B 7/00

[52] U.S. Cl. ..... 126/68; 126/67; 126/77; 126/501; 126/146; 126/190

[58] Field of Search ..... 126/68, 67, 77, 126/501, 500, 73, 146, 190

[56] References Cited

U.S. PATENT DOCUMENTS

| | | | |
|---|---|---|---|
| 4,565,184 | 1/1986 | Collins et al. | 126/68 X |
| 5,123,360 | 6/1992 | Burke et al. | 126/68 X |
| 5,137,012 | 8/1992 | Crossman, Jr. et al. | 126/501 |
| 5,243,963 | 9/1993 | Riener | 126/68 X |
| 5,429,110 | 7/1995 | Burke et al. | 126/68 |

FOREIGN PATENT DOCUMENTS

| | | | |
|---|---|---|---|
| 470822 | 8/1937 | United Kingdom | 126/501 |

*Primary Examiner*—Larry Jones
*Attorney, Agent, or Firm*—Bacon & Thomas

[57] ABSTRACT

An indoor fireplace comprises a base, a feeding device, a combustion chamber, and a ventilation device. The base has a sliding plate provided with a feeding pipe in communication with the combustion chamber. The ventilation device comprises an air drawing apparatus, an air discharging apparatus, and a plurality of air circulation ducts.

12 Claims, 6 Drawing Sheets

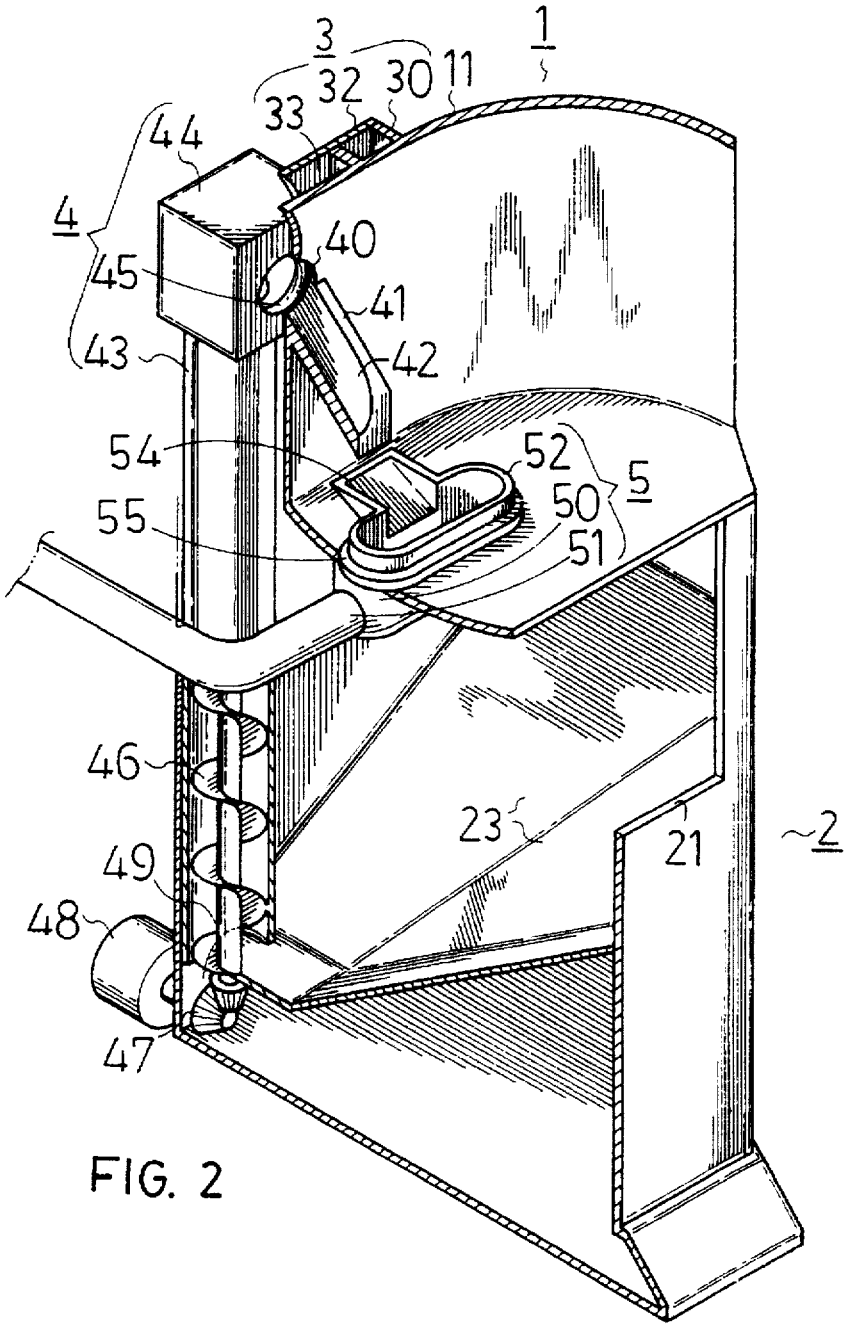
FIG. 2
FIG. 6
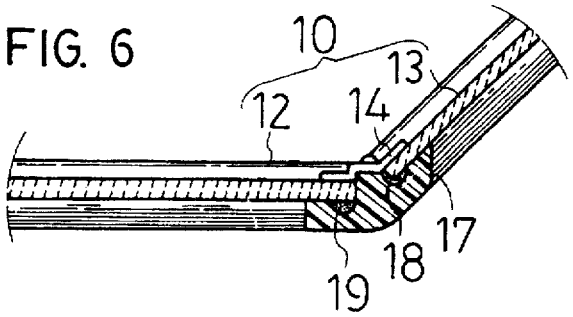

INDOOR FIREPLACE

FIELD OF THE INVENTION

The present invention relates generally to a fireplace, and more particularly to a fireplace built in the wall of a structure.

BACKGROUND OF THE INVENTION

The conventional indoor fireplace is generally defective in design in that the burning of firewood is not brought about efficiently, and that the ash left in the fireplace can not be easily removed, and further that the fireplace is poorly ventilated.

SUMMARY OF THE INVENTION

The primary objective of the present invention is to provide an indoor fireplace, which comprises a base, a firewood feeding device, a combustion chamber, and a ventilation device. The base has a sliding plate provided with a feeding tube in communication with the combustion chamber. The ventilation device comprises an air drawing means, an air discharging means, and a plurality of air circulation ducts.

The foregoing objective, features and funetions of the present invention will be more readily understood upon a thoughtful deliberation of the following detailed description of the embodiments of the present invention in conjunction with the accompanying drawings.

BRIEF DESCRIPTION OF THE DRAWINGS

FIG. 2 shows a schematic view of the feeding device of the present invention.

FIG. 6 shows a sectional view of the fireplace door of the present invention.

DETAILED DESCRIPTION OF THE INVENTION

Figure 1:
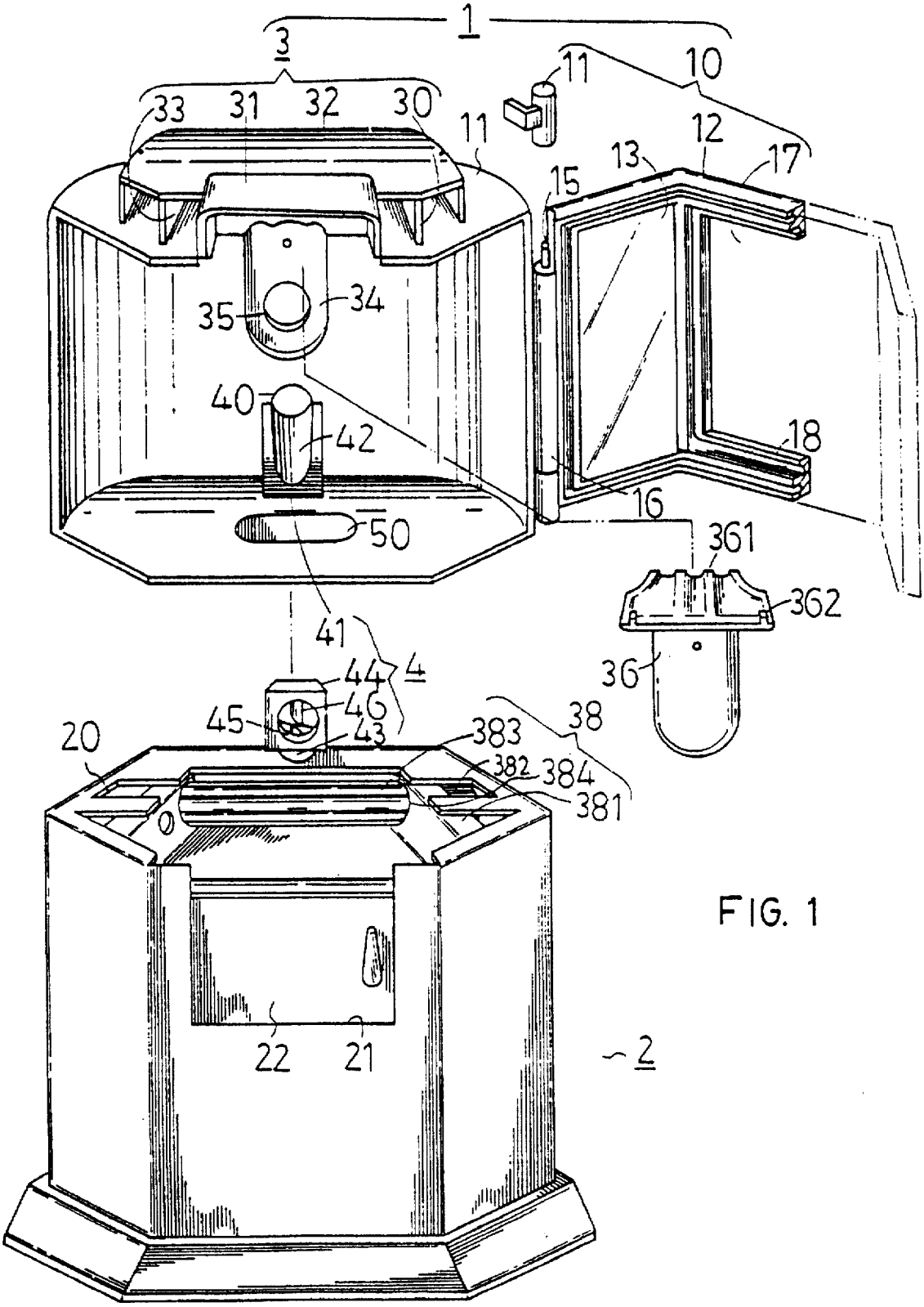
FIG. 1 shows an exploded view of the present invention.

As shown in all drawings provided herewith, a fireplace embodied in the present invention is composed of a combustion chamber 1, a base 2, an air circulation device 3, a feeding device 4, and an air intake device 5.

The combustion chamber 1 is provided with a door 10 fastened pivotally thereto. Located over the combustion chamber 1 along the wall surface 11 of the combustion chamber 1 is the air circulation device 3, which comprises an air drawing apparatus 38, a plurality of air discharging ducts 33, an air pumping apparatus 39, and a plurality of air pumping ducts 37. The air discharging duct 33 is composed of a plurality of top pieces 30, a partition 32, and an air mask 31. The air pumping duct 37 is provided with a recess 34 having an air pumping hole 35 and a cover 36. The base 2 is of a hollow construction and is provided at the top thereof with an opening 20 of a predetermined shape. Located oppositely to the open end of the combustion chamber 1 is a feeding port 21 having a feeding door 22 fastened pivotally thereto. The base 2 is provided with a sliding plate 23 of a predetermined inclination. The sliding plate 23 is connected with the feeding device 4, which comprises a feeding pipe 43 provided pivotally therein with a spiral rod 46. The wall surface 11 of the combustion chamber 1 is provided with a feeding hole 40 in communication with the feeding pipe 43. The feeding device 4 further comprises a sliding channel 41 of a predetermined inclination. Located oppositely to the sliding channel 41 is an air intake device 5, which comprises a receiving slot 50 corresponding in location to the sliding channel 41 and communicating with an air admission pipe 51. Connected with the sliding channel 41 is a combustion cup 52 having a plurality of through holes 53. The feeding device 4 is further provided with a head portion 44 provided with a feeding hole 45 corresponding in location to the feeding hole 40. The spiral rod 46 is driven by a sector gear set 47 which is driven by a motor 48. The sliding channel 41 is provided with an arcuate recess 42.

In operation, the firewood is deposited in the base 2 via the feeding port 21 of the feeding door 22. The firewood is caused to slide along the sliding plate 23 to arrive at an entrance 49 located at the bottom of the feeding pipe 43. The firewood is then driven by the spiral rod 46 to arrive at the head portion 44 and is finally dropped into the combustion chamber 1 via the arcuate recess 42 of the sliding channel 41.

Figure 3:
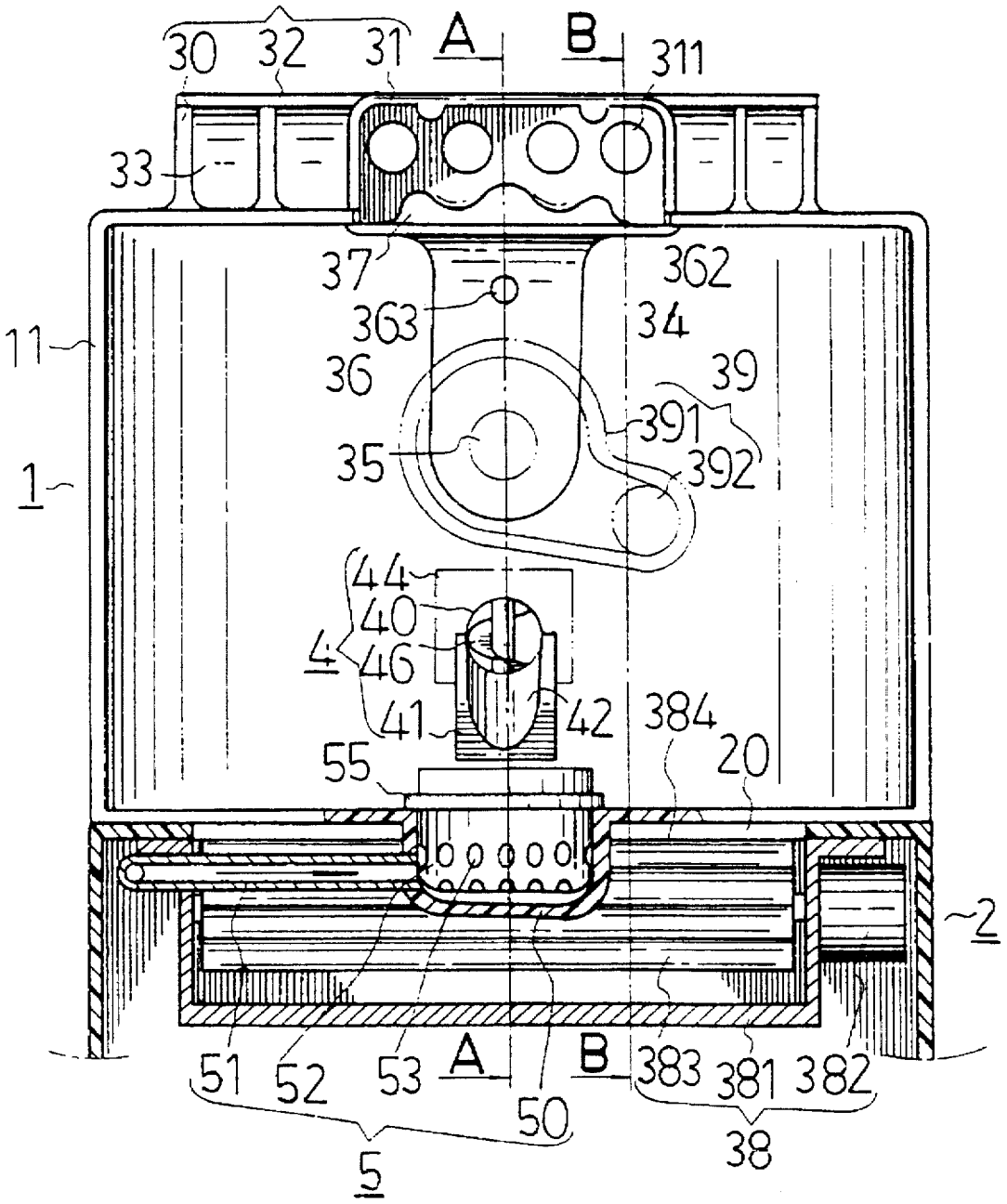
FIG. 3 shows a schematic view of the state of combustion of the present invention.

As shown in FIGS. 2 and 3, the air intake device 5 is composed of the receiving slot 50, the air admission pipe 51 and the combustion cup 52. The combustion cup 52 is provided peripherally with a ring-shaped holding portion 55 for securing the combustion cup 52 to the receiving slot 50. Located oppositely to the sliding channel 41 is a connection duct 54 having a predetermined inclination.

Figure 4:
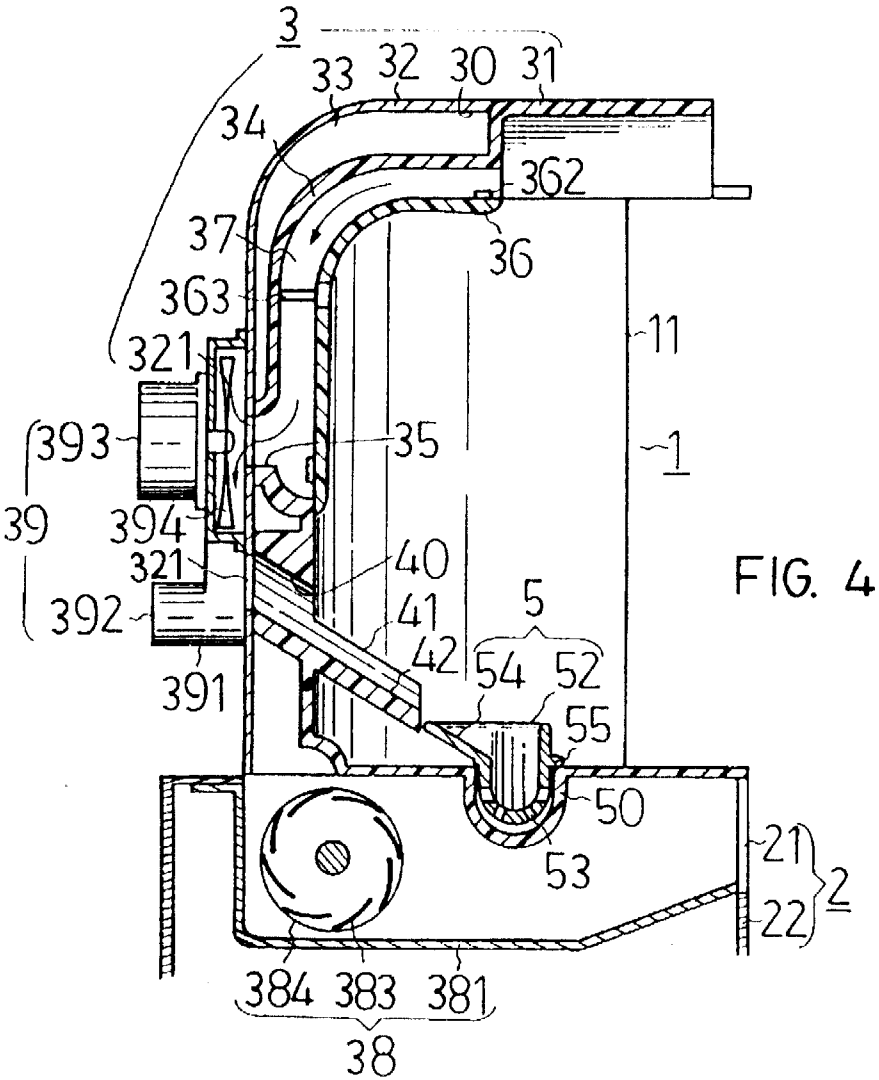
FIG. 4 shows a sectional view of a portion taken along the line A—A as shown in FIG. 3.

As shown in FIG. 4, the connection duct 54 of the combustion cup 52 is connected with the sliding channel 41 when the fireplace is in operation. As soon as the combustion cup 52 is provided with a sufficient amount of the firewood, the burning of the firewood can be started. The atmospheric air is drawn in via the through holes 53 and the air admission pipe 51. The connection duct 54 may serve as a handle to facilitate the removal of ash left in the combustion cup 52.

Figure 5:
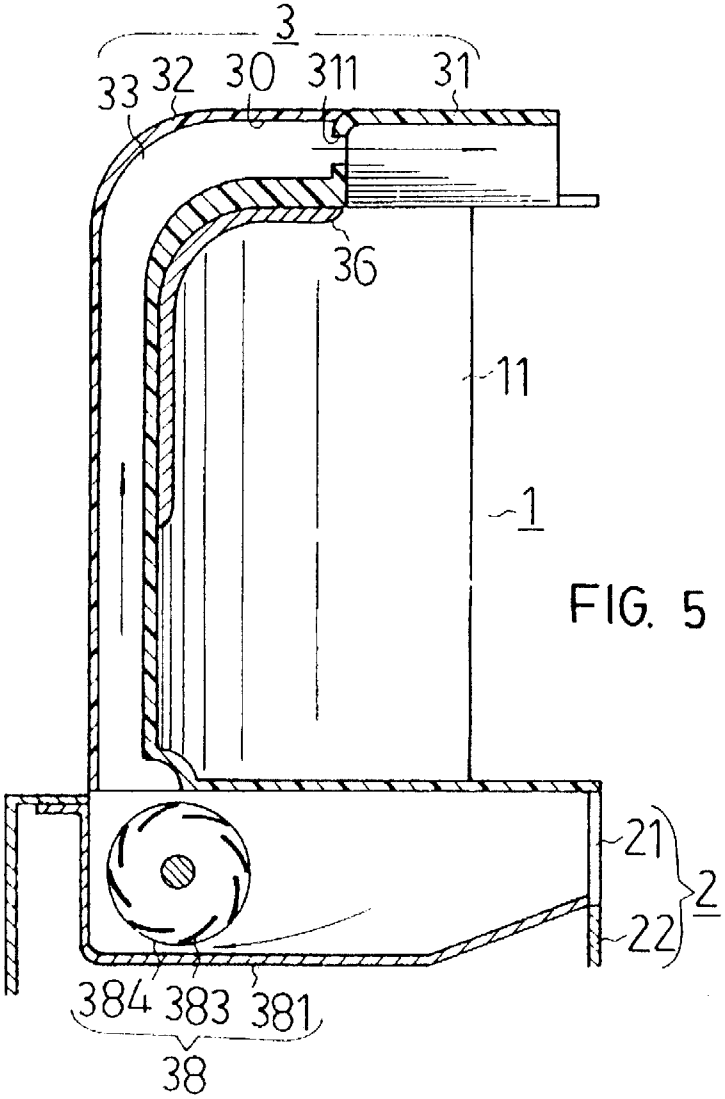
FIG. 5 shows a sectional view of a portion taken along the line B—B as shown in FIG. 3.

As shown in FIGS. 1, 3 and 5, the air circulation device 3 located over the combustion chamber 1 is composed of the air discharging ducts 33 and the air pumping ducts 37.

Figure 9:
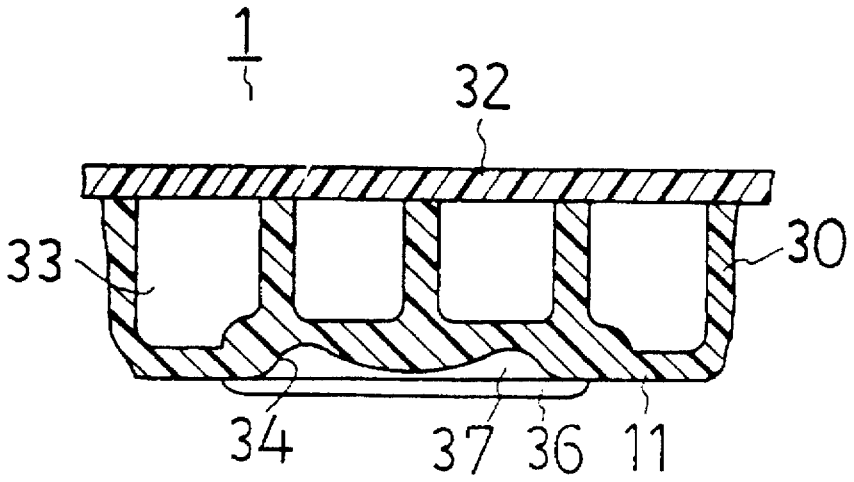
FIG. 9 shows another schematic view of the present invention at work.

As shown in FIG. 9, the air discharging ducts 33 are composed of a plurality of the top pieces 30 and a partition 32.

Figure 7:
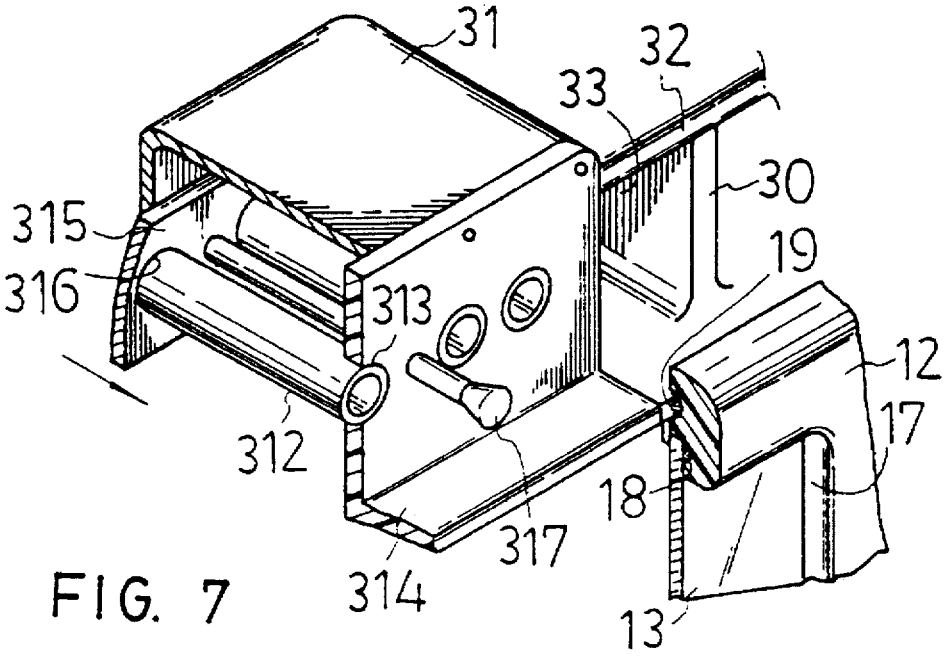
FIG. 7 shows a schematic view of the present invention at work.

As shown in FIGS. 1, 3 and 5, the air discharging ducts 33 are provided at the front end thereof with the air mask 31 having an L-shaped cross section and a plurality of air holes 311 corresponding in location to the air discharging ducts 33. As shown in FIG. 7, the air holes 311 are connected with one end of an air pipe 312 which has another end connected with a fitting hole 313 of an L-shaped gate plate 314. To facilitate the cleaning of the air pipe 312, the air pipe 312 is provided with a cleaning plate 315 having a plurality of cleaning holes 316 and a pull rod 317 which is put through the gate plate 314.

Figure 8:
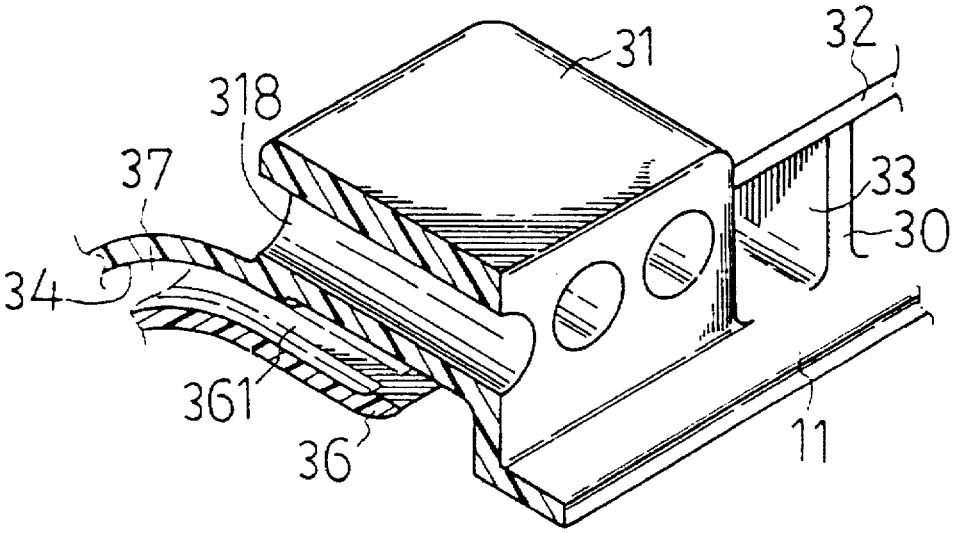
FIG. 8 shows a schematic view of the present invention at work.

As shown in FIG. 8, the combustion chamber 1 is provided at the top thereof with an air mask 31 and a plurality of warm air holes 318 corresponding in location to the air discharging ducts 33.

The base 2 is provided at the opening 20 thereof with the air drawing apparatus 38, which is made up of a frame 381 having an inverted U-shaped cross section and an inclined front end, a motor 382, and a rotary wheel 384 driven by the motor and having a plurality of blades 383.

In operation, the rotary wheel 384 is driven by the motor 382 such that the cold air is drawn in from the front end of the base 2, and that the cold air is introduced into the frame 381, the air discharging ducts 33, the air mask 31, the air pipe 312 or the warm air holes 318, as indicated by the arrows. The cold air is heated by the hot wall surface 11 of the combustion chamber 1. The warm air is then introduced into the room via the air discharging ducts 33.

As shown in FIGS. 1, 3 and 4, the wall surface 11 is provided with the recess 34 having an air pumping hole 35 which is provided with a cover piece 36 fastened with a screw 363 to from an air pumping duct 37. The partition 32 is provided with round holes 321 corresponding in location to the air pumping hole 35 and the feeding hole 40. In addition, the partition 32 is provided with an air pumping device 39 corresponding in location to the air pumping hole 35. The air pumping device 39 comprises a mask cover 391 of an inverted U-shaped construction. The mask cover 391 is provided at one end thereof with a pipe 392 and at another end thereof with a motor 393. The mask cover 391 has blades 394. The cover piece 36 has a plurality of reinforcing ribs 361 and is provided peripherally with a retaining block 362 engageable with the recess 34.

In operation, the blades 394 are actuated by the motor 393 to rotate so as to generate a suction force in the air pumping duct 37. The carbon dioxide ($CO_2$) produced in the combustion cup 52 is drawn by the suction force to let out of the house via the air pumping duct 37, the air pumping hole 35, the round hole 321 and the pipe 392.

As shown in FIG. 6, the door 10 is composed of a frame body 12, a transparent body 13, and a plurality of press plates 14. The frame body 12 is provided with a connection portion 16 having an insertion pin 15 for engaging the connection head 16 located at one side of the combustion chamber 1. The frame body 12 is provided with a plurality of windows 17. At least one insertion slot 18 is provided between two windows 17 or in the periphery of the frame body 12. The insertion slot 18 is intended for use in receiving therein a fireproof cotton blocks 19. When the door 10 is closed, the insertion slot 18 is engaged securely with the wall surface 11 in an airtight manner, as shown in FIG. 7.

Figure 10:
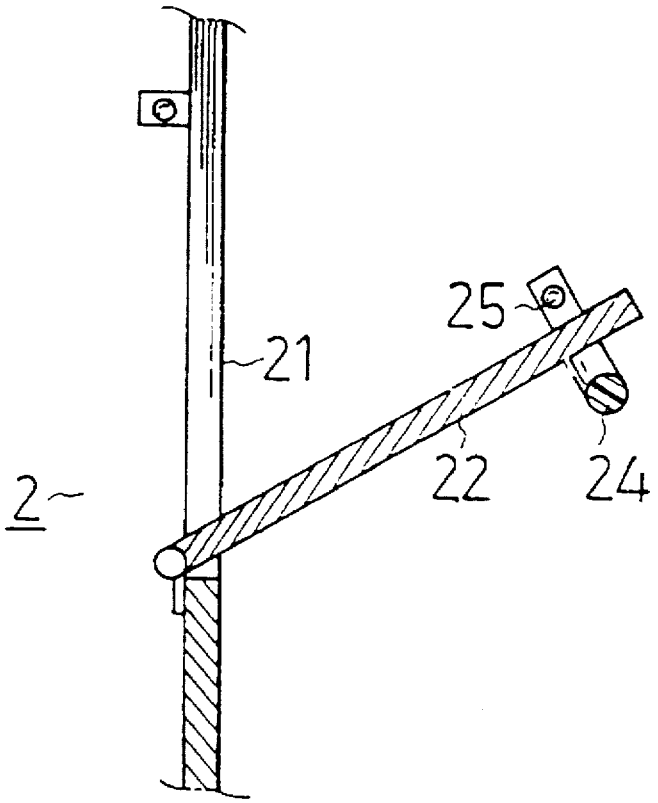
FIG. 10 shows a schematic view of the feeding door of the present invention at work.

As shown in FIG. 10, the feeding door 22 is fastened pivotally with the feeding port 21, which becomes a funnel-like structure when the feeding door 22 is opened with hand holding the handle 24 to facilitate the deposit of the firewood in the base 2. A closing element 25 is provided to facilitate the closing of the feeding door 22. The closing element 25 is corresponding in location to the feeding door 22 and the feeding port 21.

The embodiments of the present invention described above are to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A fireplace comprising a combustion chamber and a hollow base of a predetermined shape, said combustion chamber provided with a door fastened pivotally to an open end of said combustion chamber, said base provided at a top thereof with an opening of a predetermined shape, said base further provided with a feeding port and a sliding plate, said feeding port having a feeding door fastened pivotally thereto, said sliding plate being located slantingly; wherein said fireplace further comprises an air circulation device composed of a plurality of air discharging ducts and an air pumping duct, said air discharging ducts being formed by a plurality of top pieces and a partition of said combustion chamber such that said air discharging ducts are in communication with an air drawing device, said air pumping duct being formed by a recess and a cover piece located in the wall surface at the bottom of said air discharging ducts, said recess provided with an air pumping hole in communication with an air pumping device located on said partition; wherein said fireplace still further comprises a feeding device comprising a feeding pipe perpendicular to said sliding plate and communication with said combustion chamber, said feeding pipe provided therein with a spiral rod fastened pivotally thereto, said feeding pipe provided at a bottom thereof with an entrance located over said sliding plate, said feeding pipe further provided at a top thereof with a head having a feeding hole, said combustion chamber provided in a wall thereof with a feeding hole corresponding in location to said feeding hole of said feeding pipe, said partition provided with round holes corresponding in location to said feeding hole of said combustion chamber and said air pumping hole, said feeding device further provided with a sliding channel of a predetermined inclination and located under said feeding hole of said combustion chamber; and wherein said fireplace further comprises an air intake device having a receiving slot provided at one side thereof with an air admission pipe in communication with the atmosphere, said receiving slot dimensioned to retain a combustion cup having in the bottom thereof a plurality of through holes and further having a connection duct of a predetermined inclination.

2. The fireplace as defined in claim 1, wherein said air discharging ducts are provided at the front end thereof with an air mask having an L-shaped cross section and a plurality of air holes connected with an air discharging pipe which is fastened at another end thereof with a gate plate of an L-shaped construction.

3. The fireplace as defined in claim 1, wherein said air mask is made integrally with said air discharging ducts and is provided with a plurality of warm air holes corresponding in location to said air discharging ducts.

4. The fireplace as defined in claim 2, wherein said air discharging ducts are provided with a cleaning plate having a pull rod penetrating said gate plate.

5. The fireplace as defined in claim 1, wherein said air drawing device comprises a frame having an inverted U-shaped construction and having at a front end thereof a predetermined inclination, said frame provided therein with a bladed rotary wheel driven by a motor.

6. The fireplace as defined in claim 1, wherein said air pumping device is a mask cover of an L-shaped construction and provided at one end thereof with a pipe and fastened at another end thereof with a motor.

7. The fireplace as defined in claim 1, wherein said combustion cup is provided peripherally with a ring-shaped holding portion.

8. The fireplace as defined in claim 1, wherein said cover piece is provided with a plurality of reinforcing ribs and is further provided peripherally with a retaining block engageable with said recess.

9. The fireplace as defined in claim 1, wherein said spiral rod of said feeding pipe is driven by a sector gear actuated by a motor.

10. The fireplace as defined in claim 1, wherein said sliding channel is provided with an arcuate recess.

11. The fireplace as defined in claim 1, wherein said door is composed of a frame body similar in shape to said open end of said combustion chamber, a plurality of transparent bodies and a plurality of press plates, said frame body provided at one side thereof with a connection portion having insertion pins for engaging said connection head located at one side of said combustion chamber, said frame body further provided with a plurality of windows and with at least one insertion slot located between said windows and a periphery of said frame body, said insertion slot intended for receiving therein a fireproof cotton block.

12. The fireplace as defined in claim 1, wherein said feeding door is fastened pivotally at a bottom thereof with said feeding port and is provided with a closing element corresponding in location to said feeding port.

* * * * *